United States Patent [19]

Weiss

[11] 4,093,237

[45] June 6, 1978

[54] CHESS BOARD GAME

[76] Inventor: Gary Douglas Weiss, P.O. Box 588, Redwood City, Calif. 94062

[21] Appl. No.: 724,733

[22] Filed: Sep. 20, 1976

[51] Int. Cl.[2] ..... A63F 3/02

[52] U.S. Cl. ..... 273/260

[58] Field of Search ..... 273/131

[56] References Cited

U.S. PATENT DOCUMENTS

| | | | |
|---|---|---|---|
| 440,737 | 11/1890 | Burge | 273/131 K |
| 1,339,013 | 5/1920 | Bennett | 273/131 AB |
| 2,133,515 | 10/1938 | Horton | 273/131 K |
| 3,610,626 | 10/1971 | Nolte | 273/131 AB |

*Primary Examiner*—Richard C. Pinkham
*Assistant Examiner*—Harry G. Strappello
*Attorney, Agent, or Firm*—Shoemaker and Mattare, Ltd.

[57] ABSTRACT

A modified chess game which can be played by two, three or four players simultaneously. The game apparatus includes a chess board, four different colored sets of chess pieces and four strategy blinders. The chess board has 100 squares and is divided into four colored sections which match the colors of the chess sets. Each section includes 25 squares, 9 alternating black and white squares along its frontier borders and 16 alternating colored and white squares in its interior. At the corner of each section are four gold stars in four squares. Along the outer borders of the sections are colored numbers which match the color of the sections to which they adjoin.

Each set of chess pieces includes 16 conventional chess pieces. They are positioned on the inner 16 squares of the corresponding colored sections by a player in accordance with the strategy agreed on beforehand. All of the chess pieces, except the pawns, are moved as in conventional chess. The pawns may be moved one square at a time, forward, backward or sideward. The pawns may be moved diagonally only to capture an opponent's piece. The object of the game is to checkmate the opponent's king.

8 Claims, 4 Drawing Figures

CHESS BOARD GAME

BACKGROUND OF THE INVENTION

1. Field of Invention

This invention relates generally to chess games.

2. Description of the Prior Art

The game of chess has been played for centuries by two players on a chess board containing 64 squares, alternately light and dark, with 2 sets of 16 chess pieces. It is a game of skill in which the outcome is almost entirely dependent on the relative skill and playing experience of the players. Because only two players may participate in the a game of chess at one time, additional players are forced to be observers, to their frustration.

SUMMARY OF THE INVENTION

The invention relates to a modified chess game which can be played by two, three or four players simultaneously. The game apparatus includes a chess board, four different colored sets of chess pieces, and four strategy blinders.

An object of this invention is to provide a modified chess game which may be played by two, three or four players simultaneously.

Another object of this invention is to provide a modified chess game which incorporates all the interest of a conventional chess game but which provides more entertainment and excitement.

Still another object of this invention is to provide a modified chess game wherein the superiority of any player may be reduced to a degree by the alliance between the other two or three players during the game.

Still another object object of this invention is to provide a modified chess game which is played with two, three or four sets of conventional chess pieces.

A further object of this invention is to provide a modified chess game which utilizes a chess board that permits the simultaneous participation of two, three or four players.

Another object of this invention is to provide a modified game in which a fixed or movable strategy position may be selected by the players.

Still another object of this invention is to provide a modified chess game wherein a strategy blinder is used by each player to conceal the initial placement of his chess pieces.

Still another object of this invention is to provide a modified chess game which may be played by two, three or four players with conventional chess pieces that move as in conventional chess except for the pawns.

A further object of this invention is to provide a modified chess game which is more interesting and entertaining than conventional chess.

Other objects, features and advantages of the present invention will be readily apparent from the following detailed description in connection with the accompanying drawings.

DESCRIPTION OF THE PREFERRED EMBODIMENT

Figure 1:
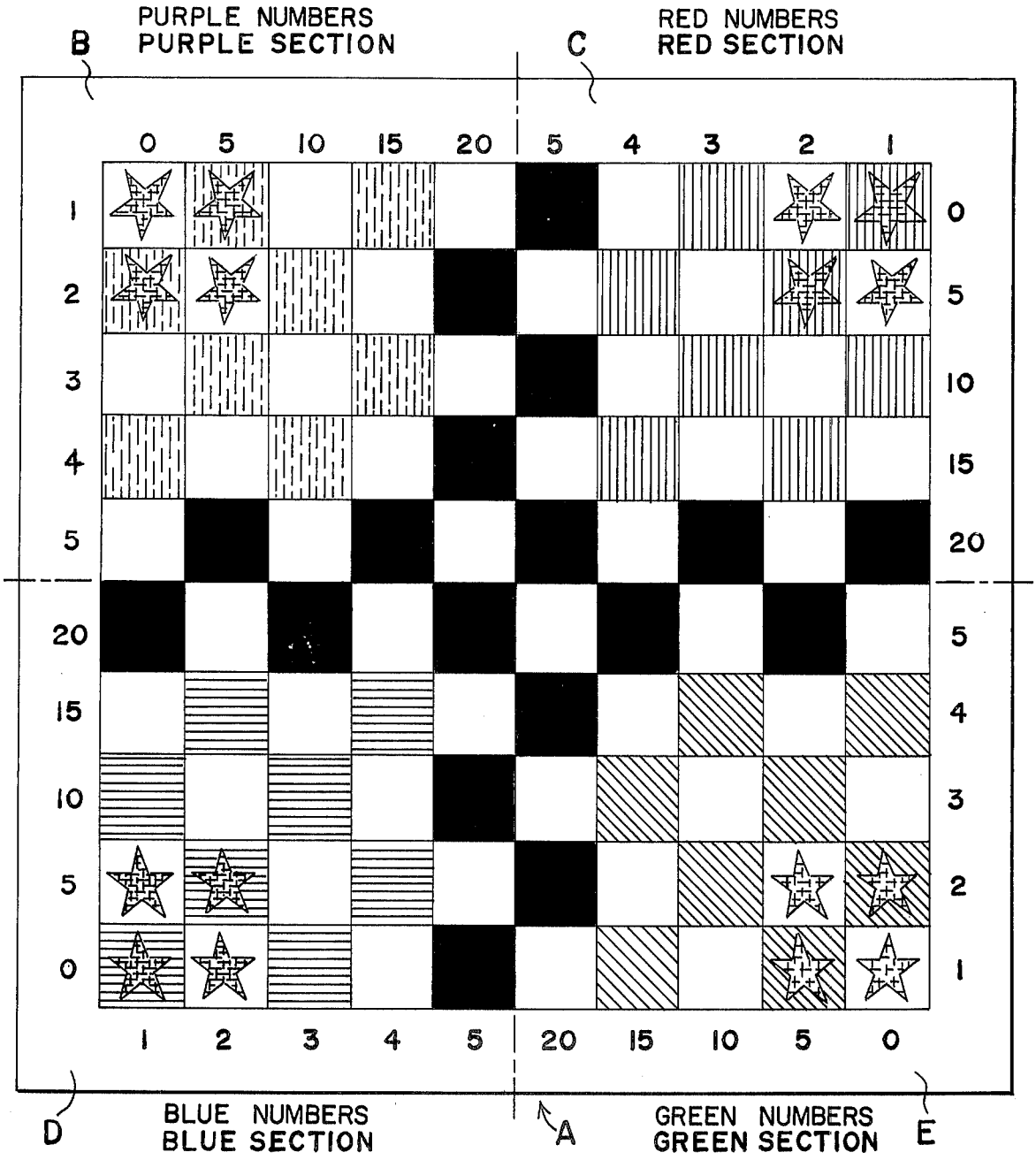
FIG. 1 is a plan view of a chess board in accordance with the invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference numerals or letters refer to like and corresponding parts throughout the several views, the preferred embodiment of the invention disclosed in FIGS. 1-4 inclusive, includes a chess board A, four sets of chess pieces, and four strategy blinders F. Chess board A has a playing surface of 100 squares, 10 rows by 10 columns or files. It is divided into a purple Section B, a red section C, a blue section D, and a green section E. Each colored section includes 25 squares, 9 alternating black and white squares along its frontier borders and 16 alternating colored and white squares in its interior. The alternating black and white squares in each section are considered neutral territory between armies. At the corner of each colored section are four gold stars in four squares. Any other suitable marking, such as a cross, an "X", a circle or a fleur-de-lis, may be used in place of the star. Similarly, any other color, other than purple, red, blue and green, may be used in place of gold. Along the outer borders of the colored sections are colored numbers which match the color of the section to which they adjoin. The numbers 0, 5, 10, 15 and 20 are placed adjacent the left outer border of sections C and D, with the numbers being located adjacent the horizontal borders of sections B and E and sections C and D alongside the squares. The numbers 1, 2, 3, 4 and 5 are placed adjacent the right outer border of each section, alongside the squares.

Each set of chess pieces includes 16 conventional chess pieces, consisting 8 pawns, 2 knights, 2 bishops, 2 rooks, 1 queen and 1 king. The colors of the four sets of chess pieces are purple, red, blue and green. Each set has a color which corresponds to a colored section. Each set is positioned in the 16 interior squares of the corresponding colored section. The king is placed in the outer corner of the section. The pawns are placed along the perimeter in squares numbered 16, 17, 18, 19, 14, 9, 4 and 13 (see FIGS. 2 and 3). The position of the other chess pieces are dependent upon whether a fixed strategy position or a movable strategy position is chosed by the players.

Figure 2:
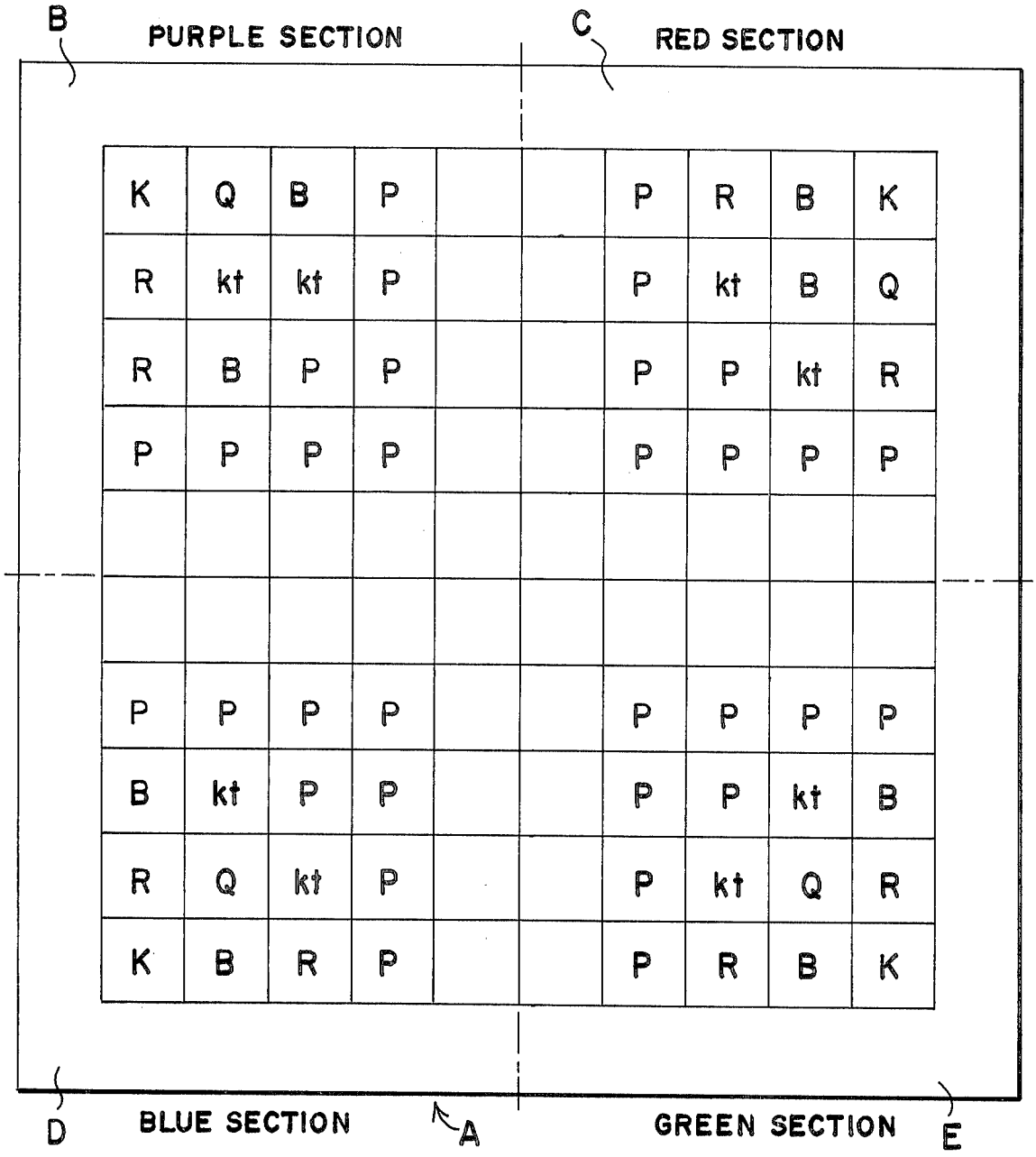
FIG. 2 is a schematic view of the chess board and the placement of chess pieces.
Figure 3:
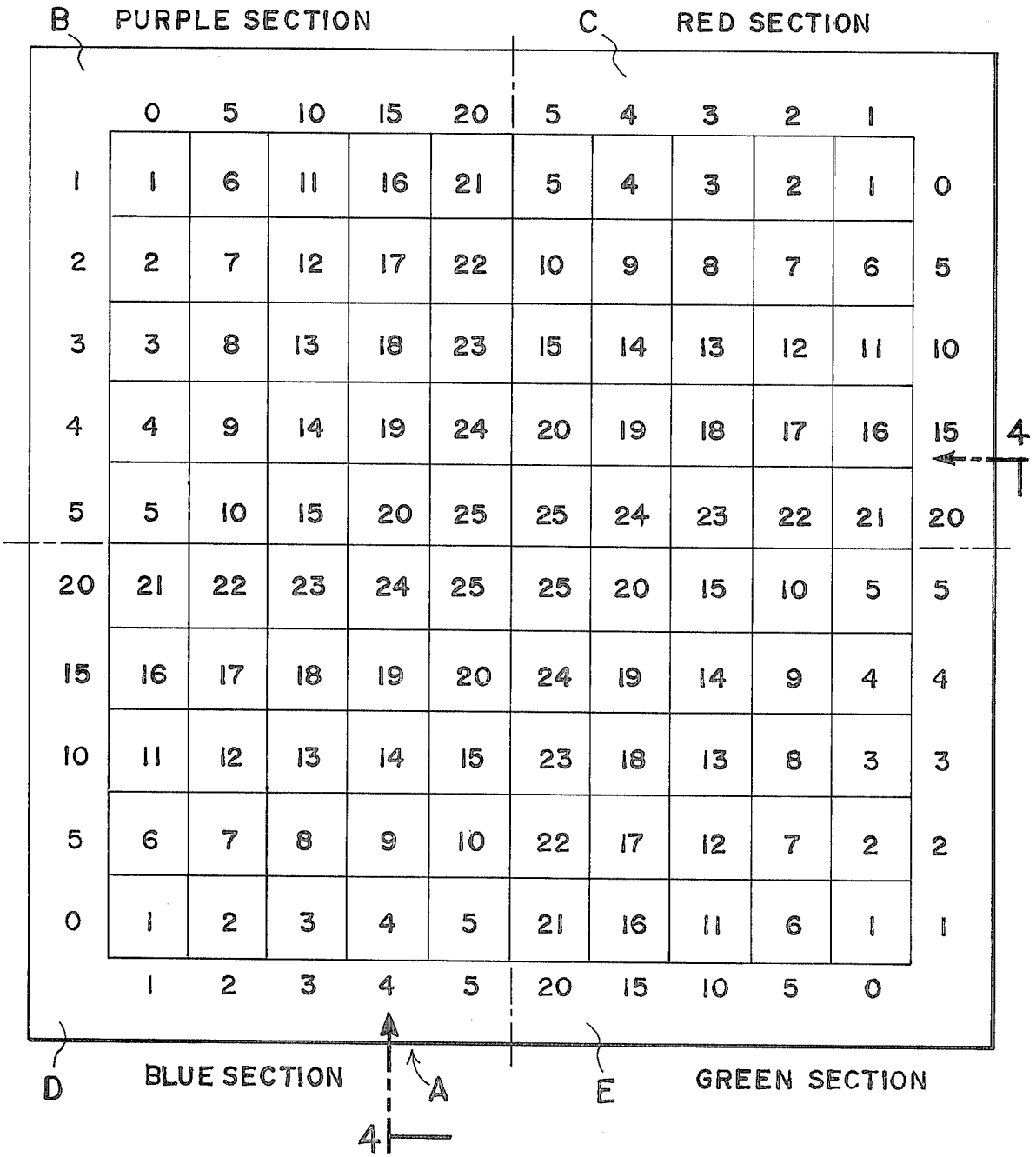
FIG. 3 is a schematic view of the chess board with each square numbered.
Figure 4:
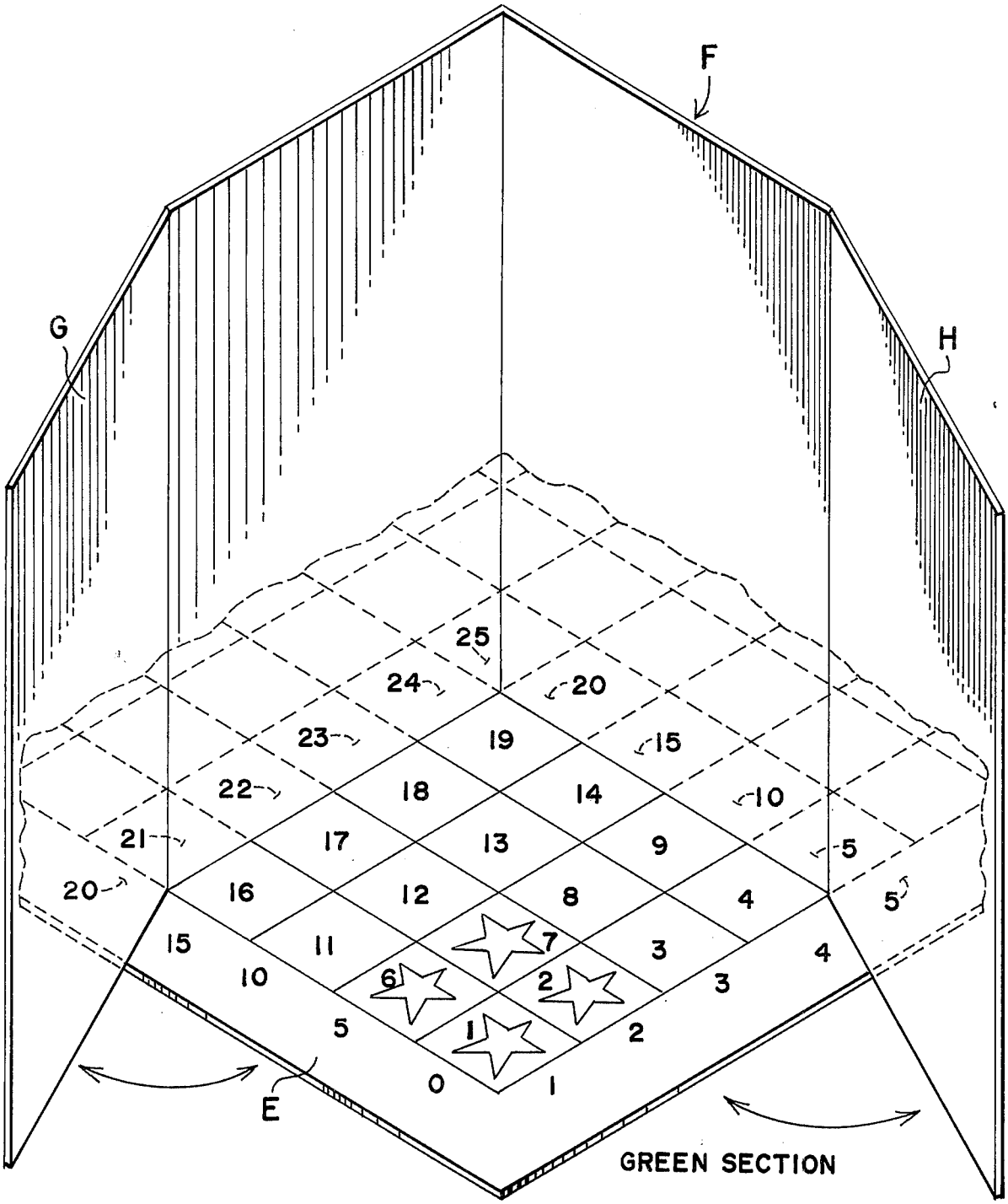
FIG. 4 is a perspective view of the strategy blinder in operation on the green section of the chess board as generally indicated by line 4—4 of FIG. 3.

If a fixed strategy position is chosed, the players agree before the game on a certain placement of the other chess pieces. The agreed placement is the same for each player. The different positioning of the other chess pieces in purple, red and green sections in FIG. 2 are examples of such positioning. The same positioning of the other chess pieces in blue and green sections in FIG. 2 indicate what must occur once the positioning is agreed on.

If a movable strategy position is chosen, each player places his own colored chess pieces, except the pawns and king, in whatever position he desires. The only limitation is that one bishop must be on a colored square and the other bishop must be on a white square. In order to conceal the placement of the chess pieces, a strategy blinder F is used by each player. The blinder F is approximately twelve inches in height and in length covers the perimeter of 16 squares. The width must be such that it can stand by itself. The blinder F is bent at three locations to form four equal parts. The end portions are designated G and H.

The perimeter squares are 1, 2, 3, 4, 9, 14, 19, 18, 17 and 16. The blinder F may cover the entire perimeter defined by those squares or may cover only the outer perimeter as defined by 4, 9, 14, 19, 18, 17 and 16, and extend on each side of that perimeter to the length of one side of squares off the board and to either side. See FIG. 4, for example of the latter. By closing end portions G and H the entire perimeter is covered. When all players have finished positioning their chess pieces, the strategy blinders are removed and the game begins.

All of the chess pieces except the pawns are moved as in conventional chess. Pawns are moved only one square at a time, forward, backward or to either side. The only time a pawn may move diagonally is during a capture of an opponent's piece, the same as in conventional chess. A pawn may enter any of the four starred corner squares of its own color only on a capture of an opponent's piece. It may remain in the starred square as long as it is desirable. It can not move to another starred square of its own color unless it is to capture another opponent's piece. Once a pawn moves out of its own colored area, the original sixteen squares, it can only re-enter its own colored area during a capture of an opponent's piece.

If a pawn of one color arrives on any one of the four starred squares of a different color when the king of that different color is still on the board, the pawn may be replaced with any piece of the player's choice, except a king.

If a pawn of one color enters any of the sixteen squares of a different colored area and that different colored king is checkmated or resigns, the pawn is still allowed, if it is able to reach one of the four starred colored squares, to be replaced with any piece of the player's choice, except a king. To all other pawns of different colors who have not entered the different colored sixteen squares area before its king is checkmated or resigns, the territory becomes neutral.

My invention is played by two, three or four players simultaneously. Players position their set of chess pieces on the inner 16 squares of the corresponding colored sections of chess board A, according to a fixed strategy position or a movable strategy position. The players move selected pieces in sequence in a predetermined order. Play continues until checkmate of the penultimate player's king or stalemate or drawn game results between the last two players. A player is eliminated when his king is captured (Checkmate) or he resigns his king. The player who is left after the other player or players have been eliminated is the victor.

An interesting aspect of my invention lies in the option of the players to form or not form an alliance. An alliance may be formed between two or among three players in order to neutralize the strength of a stronger player. In the case of four players, two alliances may be formed. The alliance may be abandoned at any time without warning. No ally is obligated to keep the alliance intact. Allies may not advise or confer with each other. In the event that the players do not form an alliance, a battle royal develops.

A player's king is captured or checkmated whenever it cannot get out of check. A king of one color may be put in check by one or more different colored armies, but the player who puts the king into checkmate, even though other players may have the same king in check already, chooses the piece of his choice to replace the checkmated king. The player also removes that colored army's remaining pieces from the board and retains them for their point value in case of a stalemate.

Any king of any color has a chance to move out of check before he can be captured. For example, a blue king is checked by a red queen. When blue king moves during his turn, the red queen, by circumstances of the positioning of the pieces on the board, has put green king in check. The next turn is red's. The red queen cannot claim a checkmate of the green king until green king has had a chance to move out of check.

A stalemate results when a king is not in check, but is forced to move, and it is impossible for the player to move his king without putting it in check. When a stalemate arises, the player with the higher point total of captured pieces is the victor. The point value of the pieces are as follows: pawn - 1, knight - 3, bishop - 3, rook - 5, queen - 10, king - 20. The purpose of having the player with the higher point total of captured pieces being the victor is to reward the aggressive player.

A drawn game results when any of the following conditions occurs: (1) One player cannot checkmate the other. (2) The players agree to end the game. (3) A position is repeated three times, with the same player on the move each time.

A player may resign his king at any time provided the king is not in check and he gives a one move warning before he resigns.

A die may be thrown by each player to determine which player moves first. The player with the highest number moves first. A tie is broken by tossing the die until there is no match of numbers. Thereafter, movement between the players is in a clockwise direction. No player shall have two consecutive moves. Color for each player may be chosen by the toss of the die. Alternatively, the players may agree as to the color each player takes and as to who moves first. Thereafter, the movement between players is clockwise.

In order to speed up the game, an optional rule of a fixed time, such as two or three minutes for each move, may be utilized. A timer of any kind may be used to time a player's move. If a player does not move within the time limit, he must remove one of his pieces of his choice from the chess board. No player gets to retain the removed piece for its point value.

If two players are playing my invention, they may play it in one of the following four ways: (1) Diagonally opposite each other. The players claim colored sections diagonally across from each other. The two remaining colored sections are considered to be neutral territory. (2) Directly in front of each other. The two remaining colored sections are considered to be neutral territory. (3) Next to each other. The two remaining colored sections are considered to be neutral territory. (4) Two armies for each player. The armies may be next to each other or diagonally across from each other. For example, the armies may be next to each other in the blue and green sections or diagonally across from each other in the blue and red sections.

If three players are playing my invention, they may play it in one of the following three ways: (1) Each player has an army. The unoccupied colored section is considered to be neutral territory. The player who has the colored section in between the other two colored sections is at a disadvantage since he has an enemy force on both sides of him, whereas the other two players have an enemy force only on one side. (2) The player in the middle plays his own army and the army diagonally across from him. He gets an extra army to play with — a total of four armies on the board. He also gets two turns, although not consecutively. (3) The player positioned in the middle between the other two players takes twice as many turns as the other two players. He gets a turn in sequence after each of the other players. For example, assume that players occupy purple section B, red section C, and green section E and that player in section B moves first, player in section C moves next, followed by player in section E, followed by player in section C. This rule is to help offset the disadvantage of the army positioned between the other two armies.

If four players are playing my invention, they may play it as follows: (1) Select their armies and determine who moves first. (2) Set up their armies in accordance with the fixed strategy position or a movable strategy position as agreed on previously by the players on the chess board. (3) Move the selected pieces by each player in turn according to preset rules. (4) Continue to move selected pieces until checkmate of the penultimate player's king, stalemate between the last two players or a drawn game results.

The chess pieces are designated as follows: king -K, queen - Q, rook - R, bishop - B, knight - Kt, and pawn - P. The color sections are designated as follows: purple - p, red - r, blue - b, and green - g.

All of the squares of chess board A are identified by color section and number. The number is determined from FIG. 3 or by adding the two border numbers which are obtained by drawing a horizontal line and a vertical line from the square to the border. For example, green queen in FIG. 2 is in g7 (2 + 5 = 7).

To write a chess move, designate the piece, the square it was in and the square it moved to. Use "—" to indicate "moves to" and "×" to indicate "captures". For example, bPg13 — g9, means that blue pawn was on green 13 and moves to green 9; rQb7 x pQp8 means red queen on blue 7 captures purple queen on purple 8.

The colors purple, red, blue and green used for the sections are merely illustrative. The sections may be colored any four different colors. The colors black and white are also illustrative. The conventional red and black or any other combination of contrasting shadings or colorings may be used.

On the other side of the chess board, there is a standard chess playing surface of 64 squares, alternately colored light and dark. The light squares may be colored red or white, and the dark squares may be colored black.

My invention is a modified chess game which can be played by two, three or four persons simultaneously. It is a game which is like chess, but it is far more interesting and entertaining.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A modified chess game comprising a board with 100 squares which are evenly divided into four sections of 25 squares, each section having nine alternating light and dark colored squares along its interior borders and 16 interior squares which are alternating dark and light colors, each section having a characteristic color, the nine alternating light and dark colored squares of each section together forming two rows and columns of alternating light and dark colored squares in the middle portion of the board and four standard sets of chessmen, each set being colored to correspond to one of the section colors so that there are four different colored sets.

2. The modified chess game of claim 1, wherein each section has symbols in its corner squares to indicate goals.

3. The modified chess game of claim 2, wherein along the outer borders of the sections are colored numbers which match the section color to which they adjoin.

4. The modified chess game of claim 1 in combination with four strategy blinders.

5. The modified chess game of claim 1 wherein each section has symbols in its corner squares to indicate goals.

6. The modified chess game of claim 5 wherein the symbols are four stars in four squares.

7. The modified chess game of claim 6, wherein along the outer border of the sections are colored numbers which match the color of the section to which they adjoin.

8. The modified chess game of claim 7, wherein the light color is white, the dark color is black, the section colors are purple, red, blue and green, and the color of the stars is gold.

* * * * *